US005695015A

United States Patent [19]

Barr et al.

[11] Patent Number: 5,695,015

[45] Date of Patent: Dec. 9, 1997

[54] SYSTEM AND METHOD OF CONTROLLING ROTATION OF A DOWNHOLE INSTRUMENT PACKAGE

[75] Inventors: John D. Barr, Cheltenham; William C. Motion; Michael K. Russell, both of Prestbury, all of England

[73] Assignee: Camco Drilling Group Ltd. of Hycalog, Stonehouse, England

[21] Appl. No.: 604,316

[22] Filed: Feb. 21, 1996

[30] Foreign Application Priority Data

Feb. 25, 1995 [GB] United Kingdom ..... 9503828

[51] Int. Cl.[6] ..... E21B 47/01

[52] U.S. Cl. ..... 175/45; 175/61; 175/73

[58] Field of Search ..... 175/45, 61, 73

[56] References Cited

U.S. PATENT DOCUMENTS 5,265,682 11/1993 Russell et al. ..... 175/73 X

FOREIGN PATENT DOCUMENTS 878895 11/1981 U.S.S.R. ..... 175/61
2214541 9/1989 United Kingdom .
2252992 8/1992 United Kingdom .
2257182 1/1993 United Kingdom .
2259316 3/1993 United Kingdom .
2289909 12/1995 United Kingdom .
2298216 8/1996 United Kingdom .

*Primary Examiner*—David J. Bagnell

[57] ABSTRACT

A system for controlling the rotation of a roll stabilizable control unit in a steerable rotary drilling assembly comprises an instrument carrier rotatably mounted on a support connected to the drill string. A first rotatable impeller is mounted for rotation by a flow of drilling fluid over the impeller and is coupled to the instrument carrier so as to transmit a torque to it. Sensors carried by the instrument carrier sense the rotational orientation of the instrument carrier and produce a control signal indicative of its rotational orientation, and the torque applied to the instrument carrier by the impeller is controlled, at least partly in response to said signal, so that the instrument carrier can, for example, be roll stabilized if required. A second rotatable impeller is coupled to the instrument carrier for transmitting to it a second torque, which may also be controlled, in the opposite direction to the torque transmitted by the first impeller. The provision of two opposed impellers allows the rotation of the control unit to be controlled over a greater range than is possible with a single impeller.

22 Claims, 5 Drawing Sheets

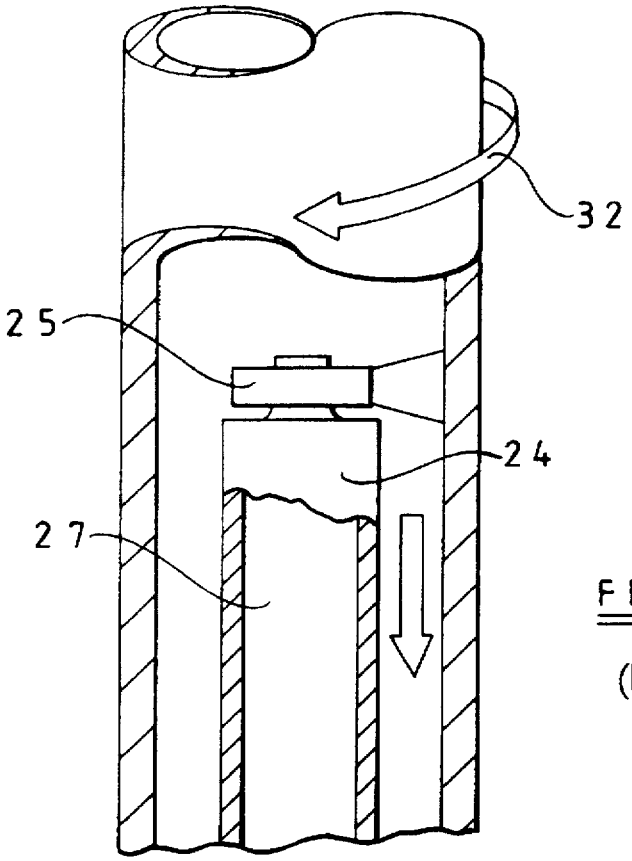
FIG 3
(Prior Art)
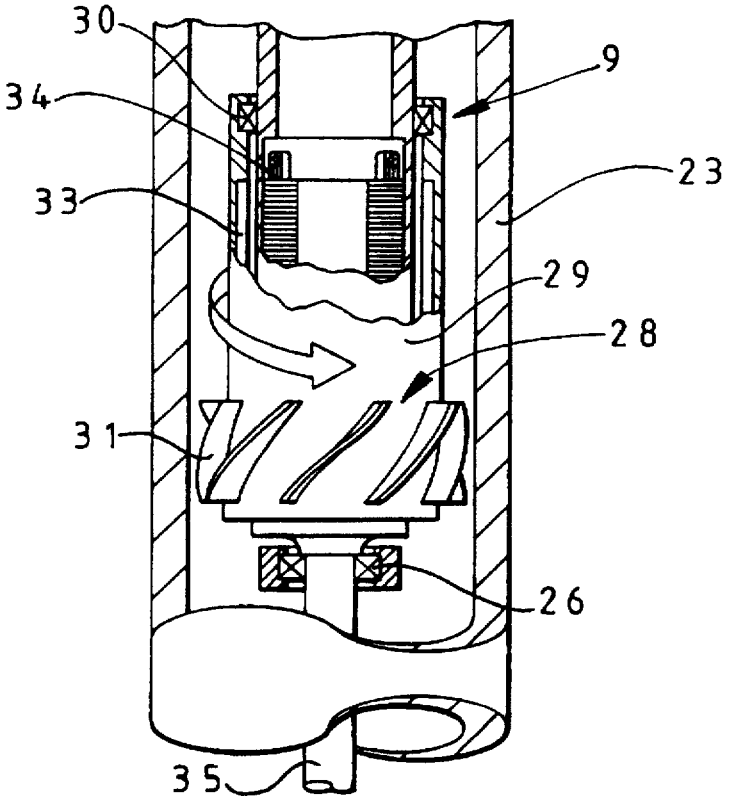

SYSTEM AND METHOD OF CONTROLLING ROTATION OF A DOWNHOLE INSTRUMENT PACKAGE

BACKGROUND OF THE INVENTION

1. Field of the Invention

The invention relates to steerable rotary drilling systems and provides, in particular, systems and methods for controlling the rotation of a downhole instrument package in such a system.

2. Setting on the Invention

When drilling or coring holes in subsurface formations, it is sometimes desirable to be able to vary and control the direction of drilling, for example to direct the borehole towards a desired target, or to control the direction horizontally within the payzone once the target has been reached. It may also be desirable to correct for deviations from the desired direction when drilling a straight hole, or to control the direction of the hole to avoid obstacles.

Rotary drilling is defined as a system in which a bottom hole assembly, including the drill bit, is connected to a drill string which is rotatably driven from the drilling platform at the surface. Hitherto, fully controllable directional drilling has normally required the drill bit to be rotated by a downhole motor. The drill bit may then, for example, be coupled to the motor by a double tilt unit whereby the central axis of the drill bit is inclined to the axis of the motor. During normal drilling the effect of this inclination is nullified by continual rotation of the drill string, and hence the motor casing, as the bit is rotated by the motor. When variation of the direction of drilling is required, the rotation of the drill string is stopped with the bit tilted in the required direction. Continued rotation of the drill bit by the motor then causes the bit to drill in that direction.

Although such arrangements can, under favorable conditions, allow accurately controlled directional drilling to be achieved using a downhole motor to drive the drill bit, there are reasons why rotary drilling is to be preferred, particularly in long reach drilling.

Accordingly, some attention has been given to arrangements for achieving a fully steerable rotary drilling system. For example, British Patent Specification No. 2259316 describes various steering arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid under pressure and an outlet passage for communication with the annulus.

A selector control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

The bottom hole assembly also includes an instrument package containing instrumentation which measures roll angle as well as, perhaps, the inclination and azimuth of the borehole and other parameters.

This downhole instrument package, including the appropriate sensors, may be fixed to the drill collar and rotating with it (a so-called "strapped-down" system), or the instrument package may be arranged to remain essentially stationary in space as the drill collar rotates around it (a so-called "roll stabilized" system). Such a roll stabilized instrumentation package system is described in British Patent Specification No. 2257182. The system comprises an instrument carrier which is mounted within a drill collar for rotation about the longitudinal axis of the collar. An impeller is mounted on the instrument carrier so as to rotate the carrier relative to the drill collar as a result of the flow of drilling fluid along the drill collar during drilling. The torque transmitted by the impeller to the instrument carrier is controlled, in response to signals from sensors in the carrier which respond to the rotational orientation of the carrier, and input signals indicating the required roll angle of the carrier, so as to rotate the carrier in the opposite direction to the drill collar and at the same speed, so as to maintain the carrier non-rotating in space and hence roll stabilized. In a preferred arrangement the torque is controlled by controlling a variable electro-magnetic coupling between the impeller and the carrier.

Normally, in such an arrangement, the drill collar will be rotating clockwise, as viewed downhole, and will therefore impart a clockwise torque to the instrument carrier.

This torque is partly transmitted through the bearings in which the carrier rotates on the drill collar, and partly through drilling fluid passing through the rotating drill collar along the exterior of the instrument carrier. Clockwise torque may also be imparted by the connection between the bias unit and the instrument carrier, depending on the nature of such connection. The impeller imparts an anti-clockwise torque to the instrument carrier so as to oppose these clockwise torques and maintain the instrument carrier substantially stationary in space.

In practice, however, the impeller always imparts a minimum anti-clockwise torque to the instrument carrier, even under nominal no-torque conditions, due mainly to friction in the bearings between the impeller and the instrument carrier. If this minimum anti-clockwise torque exceeds the clockwise torque imparted to the instrument carrier, the instrument carrier will rotate anti-clockwise in space and it will be impossible to roll stabilize it by operation of the impeller. If the clockwise torque only slightly exceeds the minimum anti-clockwise torque, this will mean that the impeller must operate near the minimum end of its range of applied anti-clockwise torque. This is undesirable and may not allow the precise control over the rotation of the instrument carrier which is required. Furthermore, should the clockwise torque then fall, due for example to a change in the component attributed to the flow of drilling fluid, it may again become less than the minimum anti-clockwise torque, making it no longer possible to roll stabilize the instrument carrier.

The present invention sets out to provide an improved system where the clockwise torque is increased, preferably in a controllable manner, to overcome this problem and also to provide other advantages, as will be described.

SUMMARY OF THE INVENTION

According to the invention there is provided a system for controlling the rotation of a downhole instrumentation package with respect to a drill string, comprising: a support connectable to a drill string; an instrument carrier carried by the support; means carried by the support for permitting the instrument carrier to rotate about the instrument carrier's longitudinal axis; first rotatable impeller mounted for rotation by a flow of drilling fluid over the impeller; means coupling the first impeller to the instrument carrier for transmitting a first torque to the instrument carrier; sensors carried by the instrument carrier for sensing the rotational orientation of the instrument carrier about its longitudinal axis and producing a control signal indicative of said rotational orientation; control means for controlling, at least partly in response to said signal, said first torque applied to the instrument carrier by the first impeller; a second rotatable impeller mounted for rotation by the flow of drilling fluid over the impeller; and means coupling the second impeller to the instrument carrier for transmitting to the instrument carrier a second torque in the opposite direction to said first torque.

The provision of a second impeller may thus increase the clockwise torque imparted to the instrument carrier, thus allowing the first controllable-torque impeller to operate anywhere within its useful range. Each or either impeller may comprise a single-stage or multi-stage axial flow impeller, or a radial flow impeller. The ability of the first impeller to roll stabilize the instrument carrier effectively depends on a combination of the rate of rotation of the drill string, the flow rate of the drilling fluid, and the specific gravity of the drilling fluid (mud weight). In any particular system, therefore, there will be an operating envelope within which roll stabilization of the instrument carrier is possible. In the prior art arrangement, therefore, where only a single impeller is provided, an appropriate impeller must be employed to suit the conditions of RPM, flow rate and mud weight under which the system will be operating. If there is a change in these parameters which brings the system outside its operating envelope, it is necessary to replace the impeller by a different impeller giving a different operating envelope. The present invention, by allowing the first impeller to operate within its useful range, has the effect of shifting and/or enlarging the operating envelope so that a given system will operate effectively over a greater range of combinations of RPM, flow rate and mud weight.

The second impeller may be simply non-rotatably mounted on the instrument carrier. In this case, however, the clockwise torque which it imparts to the carrier is dependent on the rotary speed of the drill string and the fluid within it, and the flow and density of the drilling fluid, and this may still limit the size of the operating envelope unduly. In a preferred arrangement, therefore, said means coupling the second impeller to the instrument carrier include means for varying said second torque transmitted to the instrument carrier by the second impeller, the aforesaid control means also controlling said second torque.

By providing two torque-controllable impellers operating in opposite directions, the operating envelope is significantly enlarged, and it becomes possible to provide complete and accurate control over the rotational speed and rotational position of the instrument carrier. Furthermore, the provision of two controllable impellers may also allow other advantages to be achieved. For example, it allows the instrument carrier to be rotated clockwise relative to the drill string, if required, and this may be of significant advantage in some modes of operation, as will be described.

Thus, said control means may be operable to control said first and second torques at least partly in response to a control signal other than said signal which is indicative of the rotational orientation of the instrument carrier. If the impellers may thus be controlled independently of their use to roll stabilize the instrument carrier, such control may be used to transmit information from the instrument carrier to another location, at the surface or downhole, as will be described.

The means coupling each impeller to the instrument carrier may include an electro-magnetic coupling acting as an electrical generator, the torque transmitted to the carrier by the coupling being controlled by means to control the electric load applied to the generator in response to said control signal.

Each impeller may be rotatable relatively to the instrument carrier, the electro-magnetic coupling, acting as an electrical generator, comprising a pole structure rotating with the impeller and an armature fixed to the carrier. The armature may be located within an internal compartment of the instrument carrier and the pole structure located externally of the carrier, the pole structure and armature being separated by a cylindrical wall of said compartment.

Within one pole structure there may be provided a second armature fixed to the instrument carrier and cooperating with said pole structure to generate electrical power to supply electrical instruments mounted on said carrier. The second armature may be axially adjacent the first armature, said pole structure being of sufficient axial length to cooperate with both armatures.

In any of the above arrangements at least one of said impellers is preferably rotatably mounted on the instrument carrier for rotation about the longitudinal axis of the instrument carrier. Alternatively, however, at least one of said impellers might be rotatably mounted on said support for rotation about the longitudinal axis of the instrument carrier.

The invention also provides a method of controlling the rotation of a downhole instrumentation package, comprising the steps of:

(a) mounting the instrumentation package in an instrument carrier which is rotatable about a longitudinal axis relative to a drill string;

(b) rotating the instrument carrier about its longitudinal axis by means of two impellers disposed in a flow of drilling fluid passing along the drill string, said impellers being coupled to the instrument carrier to apply torques thereto in opposite directions; and (c) controlling the torque applied to the instrument carrier by at least one of said impellers to vary the rotation of the instrument carrier relative to the drill string.

The torque applied to the instrument carrier may be controlled by controlling a variable coupling between at least one of said impellers and the instrument carrier to vary the torque transmitted to the instrument carrier by the impeller.

The torque applied to the instrument carrier by at least one of said impellers may be controlled in response to signals indicative of the rotational orientation of the instrument carrier.

Alternatively, or additionally, the method may include the step of controlling the torque applied to the instrument carrier by at least one of said impellers in response to a control signal other than a signal indicative of the rotational orientation of the instrument carrier, and using the effect of said control of torque to transmit information to detection means at another location downhole or at the surface.

For example, said control of the torque may be used to apply a pressure pulse signal to drilling fluid in the borehole, said detection means being arranged to detect said pulse signal. The term "pressure pulse" will be used to refer to any detectable change in pressure caused in the drilling fluid, regardless of the duration of the change, and is not necessarily limited to temporary changes in pressure of short duration.

Thus a pressure pulse may be generated by temporarily increasing the torque imparted to the instrument carrier by at least one of said impellers. However, since the net torque applied to the instrument carrier depends on the difference between the clockwise and anti-clockwise torques, it is preferable for the pressure pulse to be generated by increasing the torque applied by each impeller by an equal amount, so that the net torque, i.e., the difference between the clockwise and anti-clockwise torques, is unchanged. The generation of the pressure pulse does not then interfere with the roll stabilization of the instrument carriers by the impellers.

Similarly, any desired change in the net torque applied to the instrument carrier for the purposes of roll stabilization is preferably effected by increasing the torque applied by one impeller and decreasing, by an equal amount, the torque applied by the other impeller. The net torque applied to the carrier thus increases in either the clockwise or anti-clockwise direction, by an amount necessary to maintain roll stabilization, but the pressure on the drilling fluid from the combined impellers remains unchanged, so that a pressure pulse, which might otherwise have been interpreted as a data pulse, is not generated.

Said control of the torque may also be used to control the rotation of the instrument carrier so as to vary its speed and/or direction of rotation, said detection means being arranged to detect said variation. For example, the control of the torque may be used to control the rotation of the instrument carrier according to a pattern of variation in speed and/or direction of rotation, said detection means being arranged to detect said pattern of variation.

The invention therefore also includes within its scope a system for transmitting information from a downhole assembly, comprising: a support connectable to a drill string; a carrier carried by the support; means carried by the support for permitting the carrier to rotate about the carrier's longitudinal axis; first and second impellers mounted for rotation by a flow of drilling fluid over the impellers; means coupling the impellers to the carrier for transmitting torques to the carrier in opposite directions; control means for controlling the torque applied to the carrier by at least one of said impellers, to vary the rotation of the carrier relative to the drill string, whereby variation of the torque applied by said at least one impeller and/or variation in the rotation of the carrier, under the control of said control means, may be used to transmit information to detection means disposed away from said carrier, either downhole or at the surface.

BRIEF DESCRIPTION OF THE DRAWINGS

FIG. 3 is a diagrammatic longitudinal section through a prior art roll stabilized instrumentation package, acting as a control unit for the bias unit of FIGS. 2 and 3.

DETAILED DESCRIPTION OF THE PREFERRED EMBODIMENTS

Figure 1:
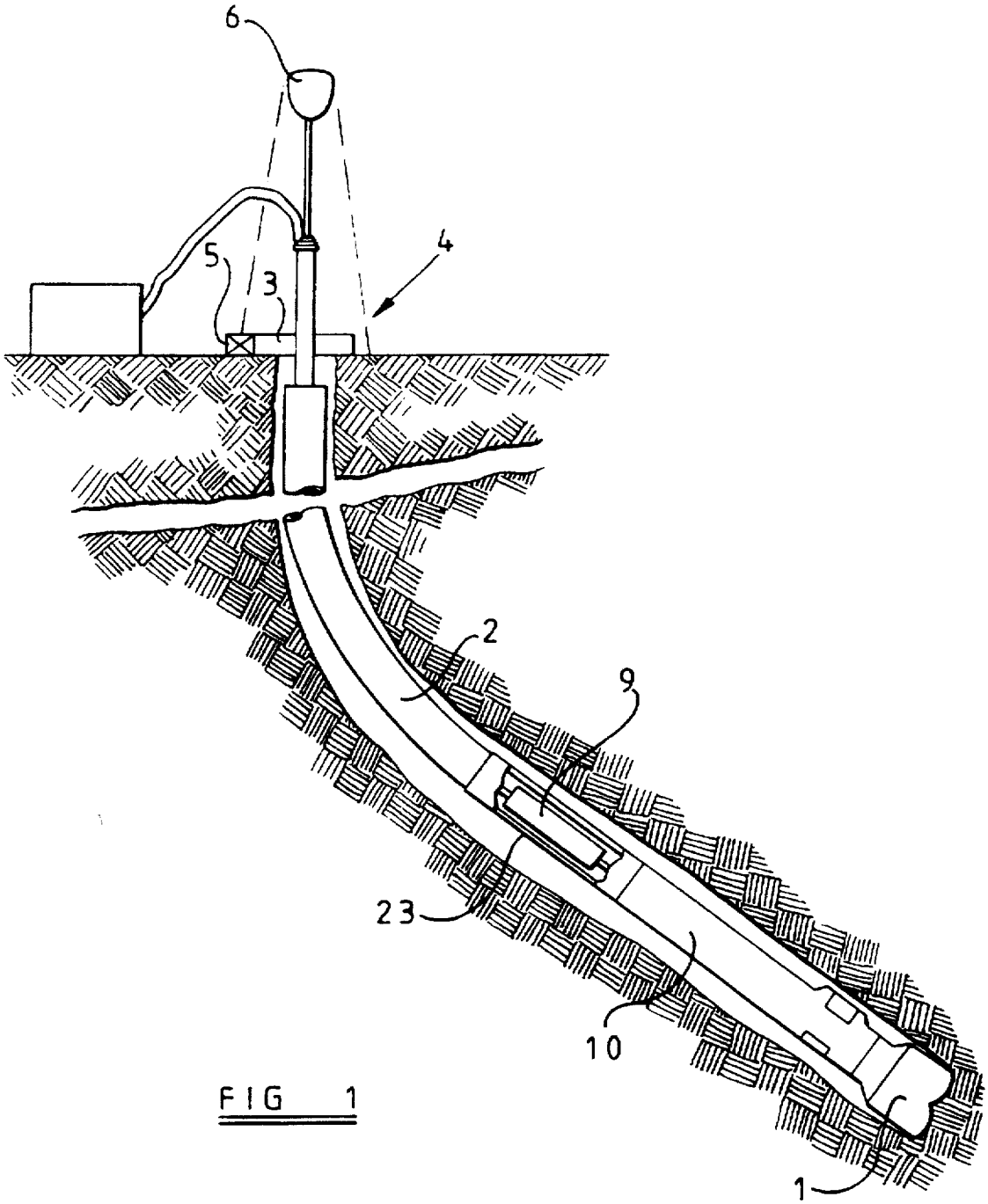
FIG. 1 is a diagrammatic sectional representation of a deep hole drilling installation.

In the following description the terms "clockwise" and "anti-clockwise" refer to the direction of rotation as viewed looking downhole. FIG. 1 shows diagrammatically a typical rotary drilling installation of a kind in which the system according to the present invention may be employed.

As is well known, the bottom hole assembly includes a drill bit 1, and is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6.

The bottom hole assembly includes a modulated bias unit 10 to which the drill bit 1 is connected and a roll stabilized control unit 9 which controls operation of the bias unit 10 in accordance with an onboard computer program, and/or in accordance with signals transmitted to the control unit from the surface. The bias unit 10 may be controlled to apply a lateral bias to the drill bit 1 in a desired direction so as to control the direction of drilling.

Figure 2:
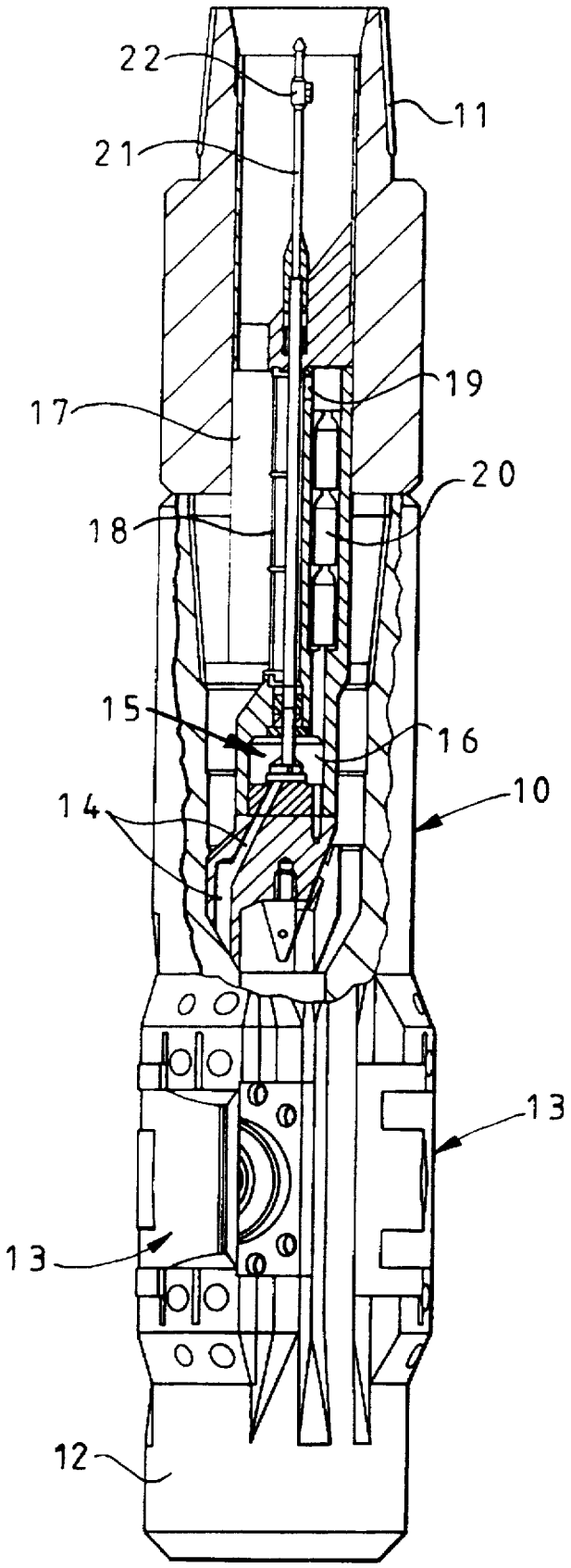
FIG 2 (Prior Art)
FIG. 2 is a part-longitudinal section, part side elevation of a modulated bias unit of a kind with which the present invention may be employed.

Referring to FIG. 2, the bias unit 10 comprises an elongate main body structure provided at its upper end with a threaded pin 11 for connecting the unit to a drill collar, incorporating the roll stabilized control unit 9, which is in turn connected to the lower end of the drill string. The lower end 12 of the body structure is formed with a socket to receive the threaded pin of the drill bit. The drill bit may be of any type.

There are provided around the periphery of the bias unit, towards its lower end, three equally spaced hydraulic actuators 13. Each hydraulic actuator 13 is supplied with drilling fluid under pressure through a passage 14 under the control of a rotatable disc valve 15 located in a cavity 16 in the body structure of the bias unit. Drilling fluid delivered under pressure downwardly through the interior of the drill string, in the normal manner, passes into a central passage 17 in the upper part of the bias unit, through a filter 18 consisting of closely spaced longitudinal wires, and through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft of the roll stabilized control unit 9.

The roll stabilized control unit maintains the shaft 21 substantially stationary at a rotational orientation which is selected, either from the surface or by a downhole computer program, according to the direction in which the drill bit is to be steered. As the bias unit rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally in a selected direction. The selected rotational position of the shaft 21 in space thus determines the direction in which the bias unit is actually displaced and hence the direction in which the drill bit is steered.

A bias unit of this kind is described in greater detail in co-pending British Patent Application No. 9411228.1. FIG. 3 show diagrammatically, in greater detail, a prior art roll stabilized control unit for controlling a bias unit of the kind shown in FIG. 2. Other forms of roll stabilized control unit are described in British Patent Specification No. 2257182.

Referring to FIG. 3, the support for the control unit comprises a tubular drill collar 23 forming part of the drill string. The control unit comprises an elongate generally cylindrical hollow instrument carrier 24 mounted in bearings 25, 26 supported within the drill collar 23, for rotation relative to the drill collar 23 about the central longitudinal axis thereof. The carrier has one or more internal compartments which contain an instrument package 27 comprising sensors for sensing the rotation and orientation of the control unit, and associated equipment for processing signals from the sensors and controlling the rotation of the carrier. Other sensors may also be included, such as an inertial angular sensor to stabilize the servo loop, and a sensor to determine the angular position of the instrument carrier relative to the drill string, and its rate of change.

At the lower end of the control unit a multi-bladed impeller 28 is rotatably mounted on the carrier 24. The impeller comprises a cylindrical sleeve 29 which encircles the carrier and is mounted in bearings 30 thereon. The blades 31 of the impeller are rigidly mounted on the lower end of the sleeve 29. During drilling operations the drill string, including the drill collar 23, will normally rotate clockwise, as indicated by the arrow 32, and the impeller 28 is so designed that it tends to be rotated anti-clockwise as a result of the flow of drilling fluid down the interior of the collar 23 and across the impeller blades 31.

The impeller 28 is coupled to the instrument carrier 24 by an electrical torquer-generator. The sleeve 29 contains around its inner periphery a pole structure comprising an array of permanent magnets 33 cooperating with an armature 34 fixed within the carrier 24. The pole/armature arrangement serves as a variable drive coupling between the impeller 28 and the carrier 24.

As the drill collar 23 rotates during drilling, the main bearings 25, 26 apply a clockwise input torque to the carrier 24 and this is opposed by an anti-clockwise torque applied to the carrier by the impeller 28. This anti-clockwise torque is varied by varying the electrical load on the generator constituted by the magnets 33 and the armature 34. This variable load is applied by a generator load control unit under the control of a computer in the instrument package 27. There are fed to the computer an input signal indicative of the required rotational orientation (roll angles) of the carrier 24, and feedback signals from roll sensors included in the instrumentation package 27. The input signal may be transmitted to the computer from a control unit at the surface, or may be derived from a downhole computer program defining the desired path of the borehole being drilled.

The computer is preprogramed to process the feedback signal which is indicative of the rotational orientation of the carrier 24 in space, and the input signal which is indicative of the desired rotational orientation of the carrier, and to feed a resultant output signal to the generator load control unit. The output signal is such as to cause the generator load control unit to apply to the torquer-generator 33, 34 an electrical load of such magnitude that the torque applied to the carrier 24 by the torquer-generator opposes and balances the bearing running torque so as to maintain the carrier non-rotating in space, and at the rotational orientation demanded by the input signal.

The output from the control unit 9 is provided by the rotational orientation of the unit itself and the carrier is thus mechanically connected by a single control shaft 35 to the input shaft 21 of the bias unit 10 shown in FIG. 2.

As previously mentioned, due to friction in the bearings 30 the impeller 28 must necessarily apply a minimum anti-clockwise torque to the carrier 24, even when the impeller is decoupled electromagnetically from the carrier. This minimum anti-clockwise torque opposes clockwise torque imparted to the carrier, for example by the bearings 25, 26, and the disc valve 15 in the bias unit. If this clockwise torque is comparatively low, it may be exceeded by the minimum anti-clockwise torque. In this case the carrier 24 will rotate anti-clockwise in space, and it will be impossible to roll stabilize it by coupling the impeller 28 to the carrier, since this will merely increase the anti-clockwise torque.

Figure 4:
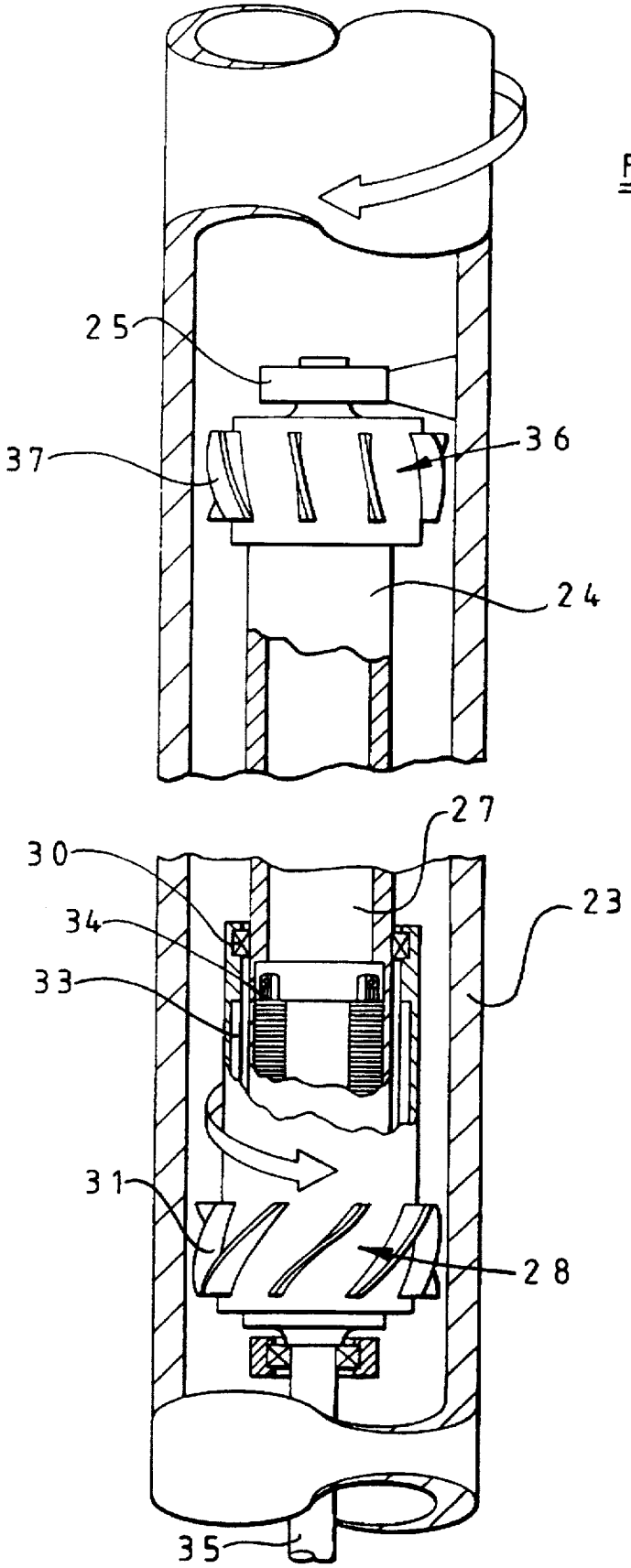
FIG. 4 is a similar view to FIG. 3 of a roll stabilized instrumentation package according to the present invention.

The present invention therefore provides arrangements where additional means are provided for increasing the clockwise torque applied to the carrier 24 and one such arrangement is shown in FIG. 4.

The arrangement of FIG. 4 is generally similar to that of FIG. 3 and corresponding parts bear the same reference numerals. However, in this first arrangement according to the present invention there is mounted adjacent the upper end of the carrier 24 a second impeller 36. The vanes 37 of the second impeller are rigidly mounted on the carrier 24, or on a cylindrical collar secured thereto, and are so orientated that the downward flow of drilling mud through the vanes imparts a clockwise torque to the carrier 24, in opposition to the anti-clockwise torque provided by the first impeller 28. The design of the impeller 36 is such that the clockwise torque it applies to the carrier 24, in combination with any other clockwise torques, exceeds the minimum anti-clockwise torque applied by the first impeller 28, while still being small enough to be overcome, when required, by the first impeller.

While such an arrangement provides significant advantage over the prior art arrangement shown in FIG. 3, it has certain limitations. For example, the clockwise torque imparted to the carrier 24 by the impeller 36 is dependent on the flow and density of drilling fluid through the impeller and cannot otherwise be varied or turned off. This limits the size of the operating envelope as far as flow rate is concerned. Also, the torque may vary depending on rotation of the drill collar 23 around the carrier 24 since such relative rotation tends to impart a rotary component to the drilling fluid so that its downward flow is helical, and the magnitude of this rotational component affects the torque generated by the flow across the impeller 36. This limits the size of the operating envelope as far as rotary speed is concerned.

In a modified arrangement, not shown, the second impeller is simply mounted in bearings on the instrument carrier 24. The friction in the bearings then, alone, couples the impeller to the carrier so as to impart an additional clockwise torque to it. This bearing friction may be supplemented, for example by provision of a spring-loaded trailing shoe brake. This reduces the dependence of its torque on rotary speed and flow rate, compared with the fixed impeller arrangement. However, such arrangements suffer from some of the same limitations as the arrangement of FIG. 4 in that the clockwise impeller torque cannot be varied or turned off.

Figure 5:
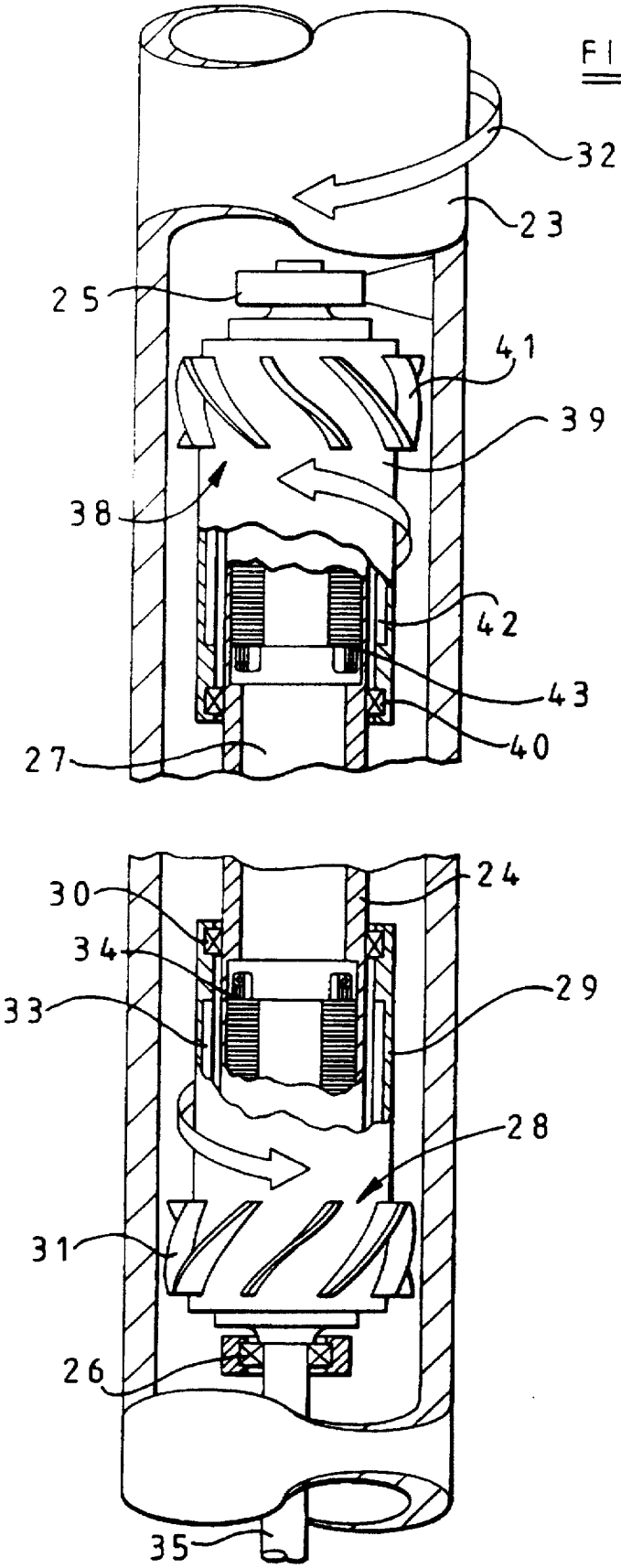
FIG. 5 is a similar view of an alternative arrangement in accordance with the present invention.

In a preferred arrangement in accordance with the invention, therefore, the second impeller is, like the first impeller 28, also coupled to the carrier 24 in such a manner that the torque it imparts to the carrier can be varied. Such an arrangement is shown in FIG. 5.

In this case the upper impeller 38 is generally similar in construction to the lower impeller 28 and comprises a cylindrical sleeve 39 which encircles the carrier casing and is mounted in bearings 40 thereon. The blades 41 of the impeller are rigidly mounted on the upper end of the sleeve 39. The blades of the impeller are so designed that the impeller tends to be rotated clockwise as a result of the flow of drilling fluid down the interior of the collar 23 and across the impeller blades 41.

Like the impeller 28, the impeller 38 is coupled to the carrier 24 by an electrical torquer-generator. The sleeve 39 contains around its inner periphery an array of permanent magnets 42 cooperating with a fixed armature 43 within the casing 24. The magnet/armature arrangement serves as a variable drive coupling between the impeller 38 and the carrier.

In this arrangement, the anti-clockwise torque may, as before, be varied by varying the electrical load on the lower torquer-generator. At the same time the clockwise torque may be varied by varying the electrical load on the upper torquer-generator. Control means in the instrument package may thus be commanded to cause any required torque, within the permitted range, to be applied to the carrier by the difference between the torques applied by the two impellers.

During steering operation of the control unit and bias unit, the control unit will require to be rotated anti-clockwise with respect to the drill collar 23 so as to be roll stabilized and stationary in space, as previously described. During such operation, therefore, the clockwise torque applied by the second, upper impeller 38 could be maintained constant so that control of the rotational speed of the control unit relative to the drill collar, and its rotational position in space, are determined solely by control of the main, lower impeller 28, the constant clockwise torque applied by the upper impeller being selected so that the main impeller operates substantially in the useful, linear part of its range. However, greater flexibility is given by controlling both impellers to give the required net torque, and this is preferred.

The provision of two impellers has two significant advantages over a single impeller arrangement. Thus, it enables the control unit to be rotated clockwise relative to the drill collar, if required, and this is simply not possible with a single impeller imparting an anti-clockwise torque. Also, the twin impeller arrangement is more effective when the drill collar is stationary since it permits correction of any overshoot which may occur when bringing the control unit to a required rotational position relative to the stationary collar. This may be achieved by using the two impellers to slow the control unit as it approaches the described position, or by reversing the rotation of the control unit if an overshoot does occur.

During other modes of operation of the bottom hole assembly, however, it may be desirable for the control unit and bias unit to be operated in a different manner. For example, it may be desirable for the control unit to perform a pattern of rotations or part-rotations in space, or relative to the drill collar 23, clockwise or anti-clockwise or in a sequence of both. Such movement may then constitute data or instructions to appropriate means responsive to such movement and located in the modulated bias unit or elsewhere. The provision of the two torque-controllable impellers gives virtually complete freedom to impart any pattern of rotary movement to the control unit and may thus be used as a means for coding a vast range of data or instructions.

Since the bias unit is under the control of the control unit, and the operation of the bias unit is consequently affected by rotation of the control unit, data encoded as pattern of rotations of part rotations of the control unit may become translated into a sequence of operations of the bias unit. As described in British Patent Specification No. 229821.6 pulses transmitted through the drilling fluid as a result of operation of the bias unit may be transmitted to the surface, or to another location downhole, and decoded. The provision of two controllable impellers coupled to the instrument carrier according to the present invention, therefore, may provide improved means for encoding data as pressure pulses from the bias unit, as described in the co-pending application.

However, as previously mentioned, the impellers of the present invention may themselves be used directly to impose a pressure pulse, or sequence of pressure pulses, on the drilling fluid so as to transmit data or instructions from the bottom hole assembly to the surface, or to a different location downhole. The means for detecting and decoding such data pulses are well known and will not be described in detail.

In the arrangements shown in the drawings, each impeller comprises a single-age axial flow impeller. However, in order to increase the pressure drop across one or both of the impellers, it may be advantageous for the impeller to be a multi-stage axial flow impeller, or an inward flow radial impeller. The increased pressure drop thus provided will increase the strength of the pressure pulses generated by the impellers and make it easier to detect such pulses over long distances, for example at the surface.

As previously described, the impellers will generate a pressure pulse in the drilling fluid if there is a temporary increase in the torque imparted to the instrument carrier by one or both of the impellers 28 and 38. The pressure of the pulse depends on the combined torques applied by the impellers to the carrier, irrespective of the direction of the torques. However, the effect of the impellers on the instrument carrier 24 depends on the net torque applied to the carrier by the impellers, that is to say on the difference between the torques.

In view of this, it is possible to control the two impellers 28 and 38 so as both to control rotation of the instrument carrier and to transmit data pulses to the surface or another location downhole, without either function interfering with the other. Thus, when it is required to transmit a pulse through the drilling fluid, the torque applied to the instrument carrier by each impeller is increased by the same amount. The overall increase of torque generates a pulse in the drilling fluid but the difference between the torques remains unchanged so that rotation of the instrument carrier is not affected.

Conversely, when it is required to modify the rotation of the instrument carrier, the torque applied by one impeller is increased by half the amount necessary to effect the required change in rotation, and the torque applied by the other impeller is decreased by the same amount. The difference between the torques, and hence the net torque, thereby changes, effecting the required change in the rotation of the instrument carrier.

However, since the total torque remains unchanged, no pressure pulse is applied to the drilling fluid.

Such twin-impeller arrangement for generating pressure pulses for telemetry may also be used in other forms of bottom hole assembly and is not limited to use in the particular form of assembly described above, where the impellers also serve to roll stabilize a control unit for a modulated bias unit in a steerable rotary drilling system.

In the prior art arrangement of FIG. 3, there is provided only a single armature 34 within the carrier 24 and this serves not only as the torquer, for applying torque to the control unit, but also as a generator for the electrical power required by the electronic instrumentation in the control unit. In practice, therefore, it may be necessary to limit the torque applied to the carrier by the impeller to less than the maximum, for example to 90%, in order to generate the electrical power required by the instrumentation. According to another aspect of the present invention, this disadvantage is overcome by extending the axial length of the magnetic array 33 within the impeller sleeve 29 and providing within the casing 24 a second armature solely for the purpose of providing electrical power for the instrumentation. The second armature is axially displaced with respect to the first armature. The pole structure and first armature are thus required only to generate torque which may thus be at the maximum level of which the system is capable.

In the arrangement of FIG. 5, the second armature is preferably associated with the second, upper impeller 38.

In the arrangements described above the impellers are rotatably mounted on the instrument carrier so as to rotate about its longitudinal axis. In such an arrangement the beatings between the or each impeller and the carrier must incorporate a thrust bearing. In order to relieve the axial load which this would otherwise impart to the carrier, such thrust bearing may be located between the impeller and the surrounding drill collar 23.

In a further alternative arrangement (not shown) each impeller may be rotatably mounted on bearings on the drill collar so that the carrier 24 is relieved of all bearing loads as a result of rotation of the impeller. In this case the only connection between each impeller and the carrier may be the electro-magnetic connection. It will be appreciated, however, that the described arrangement, where each impeller is rotatably mounted on the carrier itself, permits more accurate control of the annular gap between the magnets 33, 42 and the surface of the carrier 24.

Whereas the present invention has been described in particular relation to the drawings attached hereto, it should be understood that other and further modifications, apart from those shown or suggested herein, may be made within the scope and spirit of the present invention.

What is claimed:

1. A system for controlling the rotation of a downhole instrumentation package with respect to a drill string, comprising:

a support connectable to a drill string;

an instrument carrier carried by the support;

means carried by the support for permitting the instrument carrier to rotate about the instrument carrier's longitudinal axis;

a first rotatable impeller mounted for rotation by a flow of drilling fluid over the impeller;

means coupling the first impeller to the instrument carrier for transmitting a first torque to the instrument carrier;

sensors carried by the instrument carrier for sensing the rotational orientation of the instrument carrier about its longitudinal axis and producing a control signal indicative of said rotational orientation;

control means for controlling, at least partly in response to said signal, said first torque applied to the instrument carrier by the first impeller;

a second rotatable impeller mounted for rotation by the flow of drilling fluid over the impeller; and means coupling the second impeller to the instrument carrier for transmitting to the instrument carrier a second torque in the opposite direction to said first torque.

2. A system according to claim 1, wherein the second impeller is non-rotatably mounted on the instrument carrier.

3. A system according to claim 1, wherein said means coupling the second impeller to the instrument carrier include means for varying said second torque transmitted to the instrument carrier by the second impeller, the aforesaid control means also controlling said second torque.

4. A system according to claim 3, wherein said control means are operable to control said first and second torques at least partly in response to a control signal other than said signal which is indicative of the rotational orientation of the instrument carrier.

5. A system according to claim 3, wherein the means coupling each impeller to the instrument carrier include an electro-magnetic coupling acting as an electrical generator, the torque transmitted to the carrier by the coupling being controlled by means to control the electric load applied to the generator in response to said control signal.

6. A system according to claim 5, wherein each impeller is rotatable relatively to the instrument carrier, the electro-magnetic coupling, acting as an electrical generator, comprising a pole structure rotating with the impeller and an armature fixed to the carrier.

7. A system according to claim 6, wherein the armature is located within an internal compartment of the instrument carrier and the pole structure is located externally of the carrier, the pole structure and armature being separated by a cylindrical wall of said compartment.

8. A system according to claim 7, wherein within one pole structure there is provided a second armature fixed to the instrument carrier and cooperating with said pole structure to generate electrical power to supply electrical instruments mounted on said carrier.

9. A system according to claim 8, wherein the second armature is axially adjacent the first armature, said pole structure being of sufficient axial length to co-operate with both armatures.

10. A system according to claim 1, wherein at least one of said impellers is rotatably mounted on the instrument carrier for rotation about the longitudinal axis of the instrument carrier.

11. A system according to claim 1, wherein at least one of said impellers is rotatably mounted on said support for rotation about the longitudinal axis of the instrument carrier.

12. A method of controlling the rotation of a downhole instrumentation package, comprising the steps of:

mounting the instrumentation package in an instrument carrier which is rotatable about a longitudinal axis relative to a drill string;

rotating the instrument carrier about its longitudinal axis by means of two impellers disposed in a flow of drilling fluid passing along the drill string, said impellers being coupled to the instrument carrier to apply torques thereto in opposite directions; and controlling the torque applied to the instrument carrier by at least one of said impellers to vary the rotation of the instrument carrier relative to the drill string.

13. A method according to claim 12, wherein the torque applied to the instrument carrier is controlled by controlling a variable coupling between at least one of said impellers and the instrument carrier to vary the torque transmitted to the instrument carrier by the impeller.

14. A method according to claim 12, wherein the torque applied to the instrument carrier by at least one of said impellers is controlled in response to signals indicative of the rotational orientation of the instrument carrier.

15. A method according to claim 12, including the step of controlling the torque applied to the instrument carrier by at least one of said impellers in response to a control signal other than a signal indicative of the rotational orientation of the instrument carrier, and using the effect of said control of torque to transmit information to detection means at another location downhole or at the surface.

16. A method according to claim 12, wherein a desired change in the net torque applied to the instrument carrier for the purposes of roll stabilization is effected by increasing the torque applied by one impeller and decreasing, by an equal amount, the torque applied by the other impeller.

17. A method according to claim 12, wherein said control of the torque is used to control the rotation of the instrument carrier so as to vary at least one of its speed and direction of rotation, said detection means being arranged to detect said variation.

18. A method according to claim 17, wherein the control of the torque is used to control the rotation of the instrument carrier according to a pattern of variation in at least one of its speed and direction of rotation, said detection means being arranged to detect said pattern of variation.

19. A method of controlling the rotation of a downhole instrumentation package, comprising the steps of:

mounting the instrumentation package in an instrument carrier which is rotatable about a longitudinal axis relative to a drill string;

rotating the instrument carrier about its longitudinal axis by means of two impellers disposed in a flow of drilling fluid passing along the drill string, said impellers being coupled to the instrument carrier to apply torques thereto in opposite directions; and controlling the torque applied to the instrument carrier by at least one of said impellers in response to a control signal other than a signal indicative of the rotational orientation of the instrument carrier, and using the effect of said control of torque to apply a pressure pulse signal to drilling fluid in a borehole to transmit information to pressure pulse detection means at another location downhole or at the surface.

20. A method according to claim 19, wherein a pressure pulse is generated by temporarily increasing the torque imparted to the instrument carrier by at least one of said impellers.

21. A method according to claim 19, wherein a pressure pulse is generated by increasing the torque applied by each impeller by an equal amount, so that the net torque, i.e. the difference between the clockwise and anti-clockwise torques, is unchanged.

22. A system for transmitting information from a downhole assembly, comprising:

a support connectable to a drill string;

a carrier carried by the support;

means carried by the support for permitting the carrier to rotate about the carrier's longitudinal axis;

first and second impellers mounted for rotation by a flow of drilling fluid over the impellers;

means coupling the impellers to the carrier for transmitting torques to the carrier in opposite directions; and control means for controlling the torque applied to the carrier by at least one of said impellers, to vary the rotation of the carrier relative to the drill string, whereby variation of the torque applied by said at least one impeller, under the control of said control means, may be used to transmit information to detection means disposed away from said carrier.

* * * * *